United States Patent [19]

Vogt et al.

[11] Patent Number: 4,706,586

[45] Date of Patent: Nov. 17, 1987

[54] AUTOMATIC SEWING MACHINE HAVING A POST-ARRANGED REEL

[75] Inventors: Siegfried Vogt, Lepoldshöne; Wolfram Schulze, Bielefeld, both of Fed. Rep. of Germany

[73] Assignee: Kochs Adler AG, Fed. Rep. of Germany

[21] Appl. No.: 834,952

[22] Filed: Feb. 28, 1986

[30] Foreign Application Priority Data

Mar. 5, 1985 [DE] Fed. Rep. of Germany ..... 3507725

[51] Int. Cl.[4] ..... D05B 33/00

[52] U.S. Cl. ..... 112/121.29; 112/121.11; 242/66

[58] Field of Search ..... 112/121.29, 2, 10, 11, 112/121.11, 121.12; 242/66, 78.1, 76; 271/3, 200, 201, 207

[56] References Cited

U.S. PATENT DOCUMENTS

| | | | |
|---|---|---|---|
| 2,529,184 | 11/1950 | Pearson | 242/66 |
| 4,112,860 | 9/1978 | Ellington et al. | 112/121.29 X |
| 4,139,166 | 2/1979 | Powell et al. | 242/66 |
| 4,380,164 | 4/1983 | Kuwano | 242/78.1 X |
| 4,580,509 | 4/1986 | Scholl et al. | 112/2 |

*Primary Examiner*—Peter Nerbun

*Attorney, Agent, or Firm*—Laff, Whitesel, Conte & Saret

[57] ABSTRACT

An automatic sewing machine for successively sewing workpieces, which, in particular, are flexibly connected to one another by at least one thread chain, is provided with a reel subsequently arranged to a sewing head for receiving sewn workpieces on its substantially cylindrical core. In order to render possible a trouble-free feeding, initial catching and winding of the workpieces, a lower winder support is positioned in front of the reel for feeding and guiding the workpieces to the core of the reel. Moreover, there may be provided an upper winder support which is lowerable towards the core and which at least partially encases the latter at a side opposite the lower winder support.

10 Claims, 7 Drawing Figures

Fig. 7
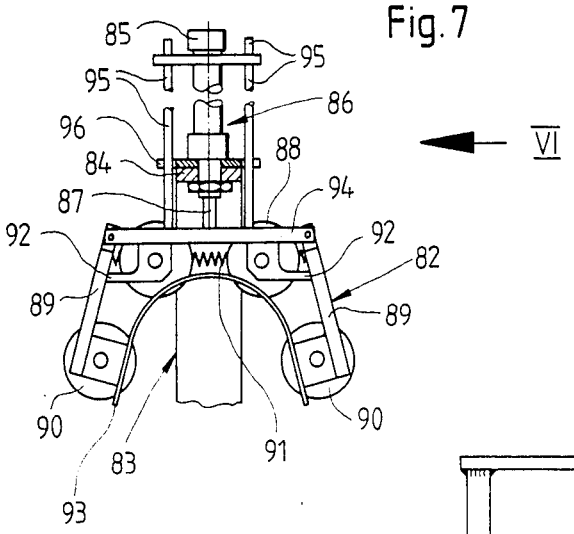
Fig. 6
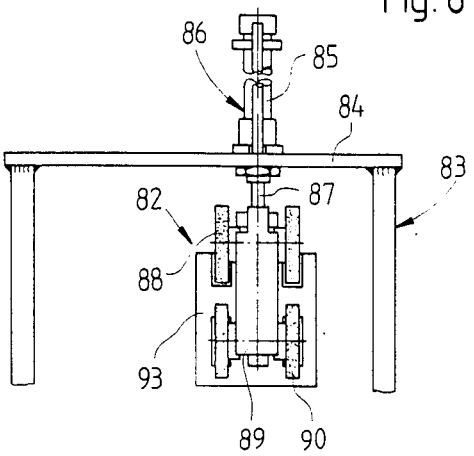
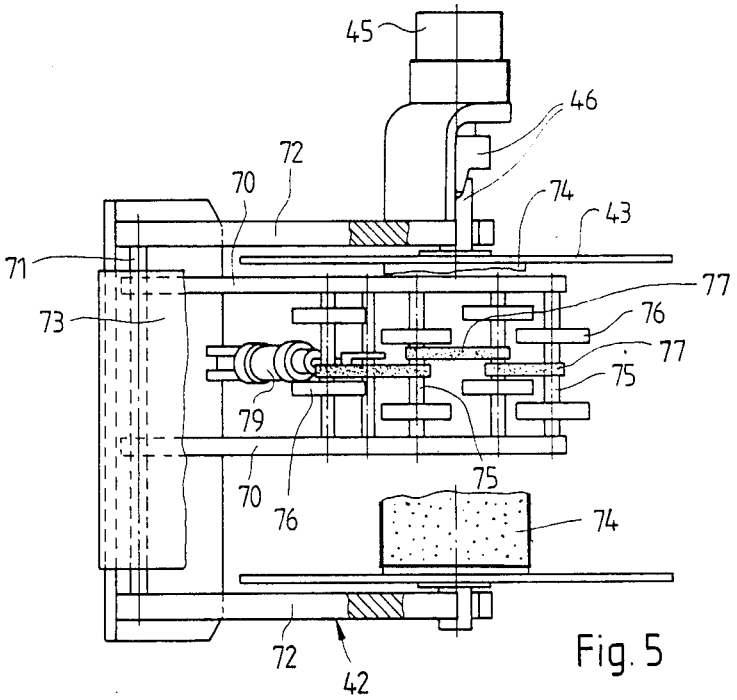
Fig. 5

AUTOMATIC SEWING MACHINE HAVING A POST-ARRANGED REEL

FIELD OF THE INVENTION

The present invention generally relates to an automatic sewing machine for successively sewing workpieces flexibly connected to one another by at least one thread chain, which particularly have a sewing head and a reel receiving sewn workpieces positioned behind said sewing head.

BACKGROUND OF THE INVENTION

U.S. Pat. No. 4,580,509 discloses an automatic sewing machine which feeds the workpieces connected to one another towards the core of the reel at its upper side. The workpieces are fastened to the reel in some manner and then wound up. An orderly feeding of the workpieces connected to one another and in particular a kind of initial catching and winding of the workpieces to the reel is not provided.

SUMMARY OF THE INVENTION

It is a main object of the invention to create an automatic sewing machine which renders possible a feeding and an initial catching and winding of the workpieces connected to one another without any problems.

According to the invention the automatic sewing machine is provided with a lower winder support arranged in front of the reel for feeding and guiding said workpieces connected to one another onto said core of said reel. By this is achieved that the workpieces flexibly connected to one another will be fed in order and in a distance to each other via the winder support to the core of the reel and brought into contact with the latter, so that an orderly winding up is rendered possible. In this connection it is without any importance whether the automatic sewing machine is provided with a reel in front of the sewing head on which workpieces already chained on to each other are existent which will be exposed to further sewing operations on the automatic sewing machine, or whether the initial chaining of the workpieces one to each other will be carried out on the automatic sewing machine.

When a lower winder support for feeding said workpiece is provided with rollers drivable in the same circumferential direction and at the same circumferential speed as the core a particularly orderly feeding of the workpieces towards the reel is achieved.

Because of a special construction no particular drive is necessary for the roller drive. This applies too, if the at least one roller engageable with the core rolls on workpieces which are already wound up on the reel. In all cases it is assured that the circumferential speed of the rollers is equal to the circumferential speed of the outer ply of the workpieces wound onto the core of the reel.

Furthermore, an improved guidance of the workpieces on the winder support will be achieved when a guiding plate is provided through which the rollers project and wherein the end adjacent to said core is adapted to the curvature of the latter. When the lower winder support is yieldingly pressable against the reel by means of a pneumatic piston-cylinder drive it is assured that the winder support will be brought to contact with the core of the reel on the one hand and that the position of the winder support can be altered on the other hand due to the already wound up workpieces.

Moreover, an upper winder support is provided in addition to the lower which is engageable with the core and which at least partially encases said core at a side opposite to the lower winder support. By this feature a very safe initial catching and winding up of the workpiece resp. workpieces on the reel is assured. Furthermore, the core of the reel can be provided with burdock material. In this case the upper winder support would not be necessary. If the core is coated by rubber or another material having a relative high coefficient of friction then an upper winder support would be appropriate as to assure that initially one up to three plies of workpieces will be wound up on the core which then guarantee a self-clamping action.

According to a further modification of the invention the upper winder support is provided with a plurality of rollers concentrically arranged one to each other, whereby the upper winder support may be brought into contact with the core or with the initially wound up workpiece respectively at a plurality of places. Furthermore, the rollers of the upper winder support may be in a displaceable manner to one another. Due to this feature a matching of the rollers with repsect to their positions is rendered possible as core diameter varies with the winding up of workpieces.

Other objects, advantages and features of the present invention will appear from the detailed description of a preferred embodiment, which will now be explained inconjunction with the accompanying drawings.

BRIEF DESCRIPTION OF THE DRAWINGS

FIG. 5 is a top plan view of the reel according to the arrow V in FIG. 4, at which the guiding plate of the lower winder support is omitted;

FIG. 6 is a side elevation of the upper winder support according to the arrow VI in FIG. 4, and FIG. 7 is a sectional view of the upper winder support taken along line VII—VII in FIG. 6.

DESCRIPTION OF THE PREFERRED AND MODIFIED EMBODIMENTS

Figure 1:
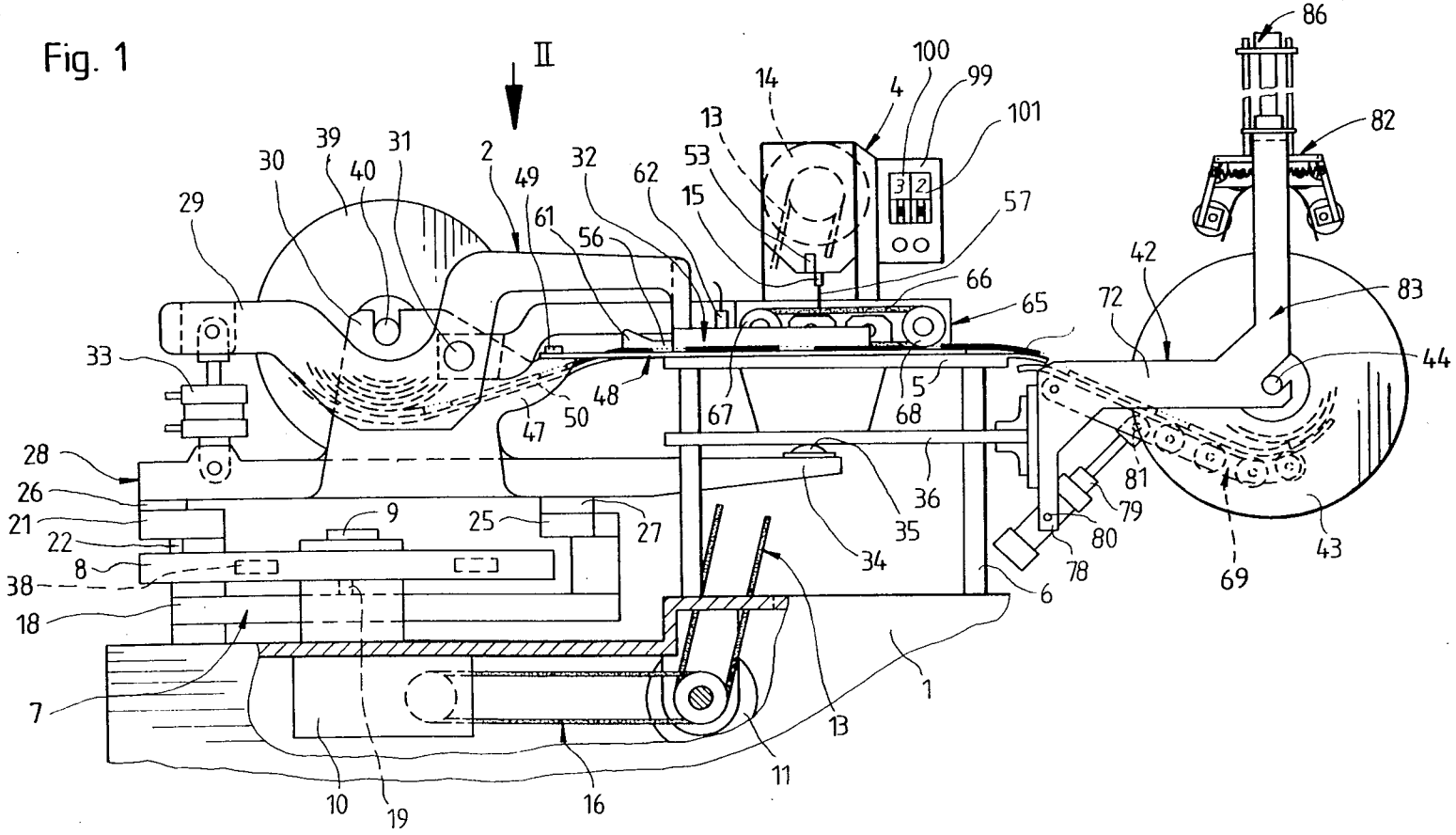
FIG. 1 is a longitudinal side view of an automatic sewing machine according to the invention, and according to the arrow I in FIG. 2.

Referring to FIGS. 1–4 of the drawings there is illustrated an automatic sewing machine mounted on a stand 1 having a plate 5, which is secured thereto by means of posts 6 for receiving a feeding device 2 for a workpiece 3 and a sewing head 4.

The feeding device 2 is provided with a linkage system 7, which, in principle, consists of a parallelogram lingkage cooperating with a control disc 8. The control disc 8 is secured to an off-drive shaft 9 of a gear 10 mounted at the stand 1 and driven by a drive motor 11 of the automatic sewing machine also mounted inside the stand 1. The motor 11 is connected to a handwheel 14 of the sewing head 4 via a clutch 12 and a belt drive 13 for driving - depending on whether the clutch 12 is engaged - a needle bar 15. The needle bar is on the sewing head 4 and carries a needle 57. The drive motor 11 is drivingly connected via a further belt drive 16 to the gear 10.

Figure 2:
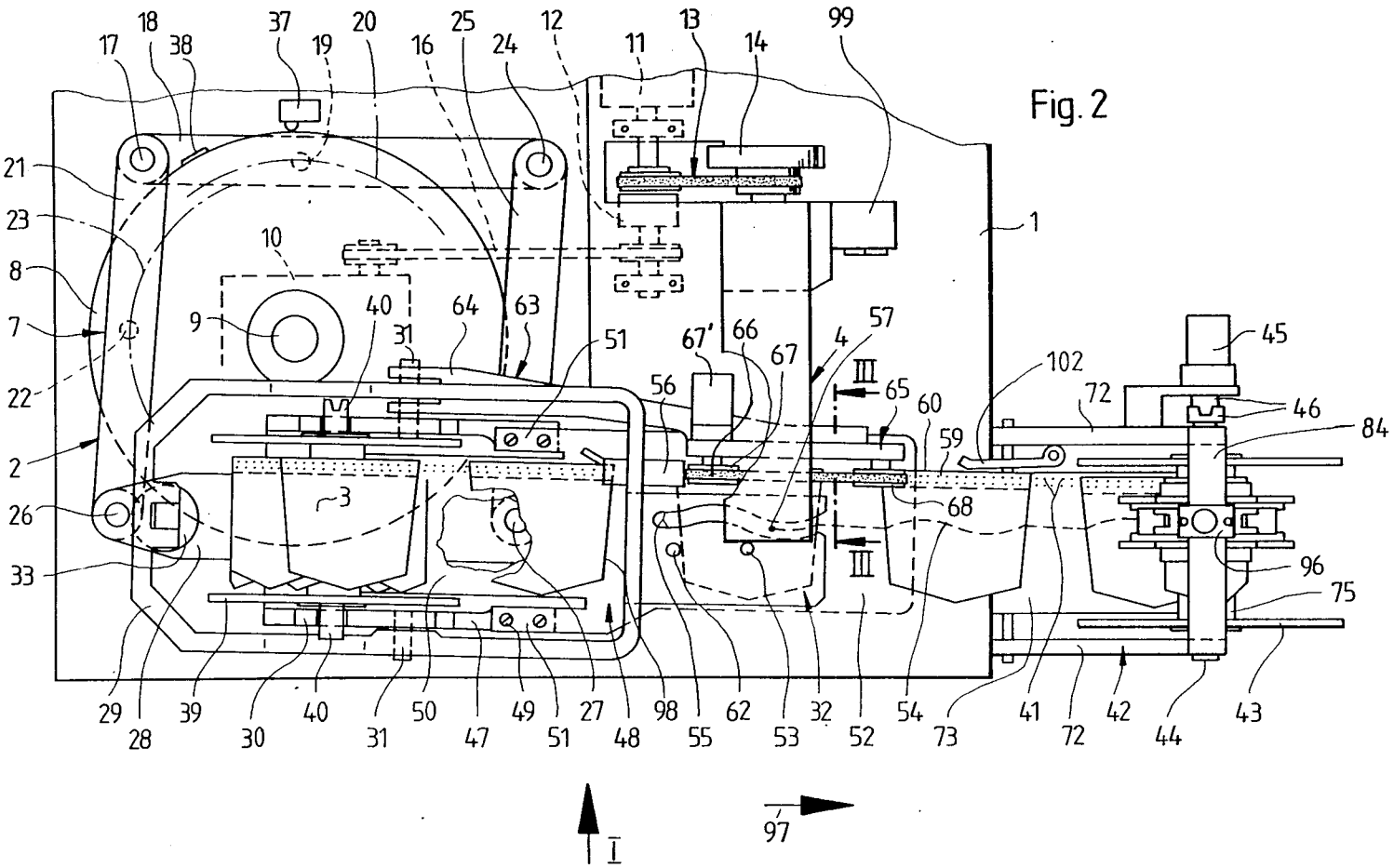
FIG. 2 is a top plan view of the automatic sewing machine according to the arrow II in FIG. 1, at which a non-relevant portion is omitted.

Referring to FIG. 2, the linkage system 7 is provided with a fixed fulcrum formed by an axle 17, secured to the stand 1. A guide lever 18 is swingably supported at the axle 17 and arranged below the control disc 8 parallel to the main direction of the sewing head 4. The guide lever 18 has a guide roller 19 that engages a control groove 20 formed in the lower surface of the control disc 8.

A further or second guide lever 21 is swingably supported at the axis 17 and arranged above the control disc 8 perpendicularly with respect to the lower guide lever 18, and parallel to the main direction of the sewing head 4. Guide lever 21 has a downwardly projecting guide roller 22 that engages a control groove 23 formed in the upper surface of the control disc 8. The control grooves 20, 23 extend as closed grooves along the total periphery of the control disc 8, of course they are not circularly profiled. The other end of the lower guide lever 18 is hinged to one end of the intermediate lever 25 via a link 24. The intermediate lever 25 extends parallel to the upper guide lever 21 and is above the control disc 8. An off drive lever 28 is connected to the other end of the upper guide lever 21 and the other end of the intermediate lever 25 via links 26, 27. The off-drive lever 28 extends parallel to the lower guide lever 18 and is located above the plane formed by the upper guide lever 21 and the intermediate lever 25. The linkage system 7 defined by the four joints 17, 24, 26, 27 is a parallelogram-link-system having nearly right angles and equal shanks.

A bearing block 30 and a supporting arm 29 are secured to the off-drive lever 28. The supporting arm 29 is swingable about the horizontal axis 31, which extends parallel to the main direction of the sewing head 4. A workpiece holder 32 is mounted on the free or front end of the supporting arm 29.

The supporting arm 29 is swingable by means of a pneumatic piston-cylinder-tilt-drive 33, which is mounted to the off-drive lever 28 and the supporting arm 29. When pressurized, the drive 33 will be shortened, so that the workpiece holder 32 is tilted upwardly from the operative position also illustrated in the drawing into a not illustrated position. The off-drive lever 28 has a counter-thrust-arm 34 extending below the workpiece holder 32. A supporting roller 35 on the counter-thrust-arm 34 abuts against a pressure plate 36 mounted to the posts 6. This ensures that sufficient pressing forces are available when the workpiece holder 32 is lowered for sewing, i.e. the drive 33 is an extended position. A fixed electrical switch 37 is attached to the stand 1. The switch 37 cooperates with cams 38 secured to the outer periphery of the control disc. This causes transmission of an electrical signal to an electronical controller at a determined angle position of the control disc 8.

In the bearing block 30, a removable first reel 39 is pivoted about axle journals 40. The removable reel 39 receives a plurality of workpieces 3, which are connected together by a thread chain 41. The thread chain 41 is achieved by successively doing the same sewing procedure or individual workpieces, i.e. after termination of the seam at one workpiece, the sewing machine continues sewing until the beginning of the seam at the next following workpiece. Consequently, the individual workpieces 3 are each positioned to each other in the same position along the thread chain 41. On the stand 1 to the side of the sewing head 4 opposite the reel 39, a projecting bearing block 42 is fastened. The projecting bearing block 42 supports a sound removable take-up reel 43 by axle journals 44. After termination of the still hereinafter described sewing operations, the take-up reel 43 receives the workpieces connected together by a seam. The reel 43 is driven by a motor 45 secured via a clutch 46 and one axle journal 44 and constantly imparting a slight torque to the reel 43.

On both sides of the reel 39 there are arms 47 projecting from the bearing block 30 in the direction to the sewing head 4. A guiding device 48 is connected to the arms 47 by screws 49. This guiding device 48 is substantially bent from resilient thin sheet metal and provided with a longer resilient guiding section 50 reaching below the reel 39 and resting against the workpieces 3 received by the reel 39. Parallel to the guiding section 50 there are formed webs 51 over cutouts. The webs 51 are secured by the screws 49 to the arms 47. Adjacent to the guiding section 50 and continuous therewith is formed a supporting plate 52 extending below the sewing head 4. The workpieces 3 each to be sewn are clamped to the supporting plate 52 by the workpiece holder 32 which forms a clamping plate. The workpiece holder 32 is secured to the front end of the supporting arm 29 embracing the reel 39 like a fork. A recess 55 profiled according to the contour of the seam 54 to be produced is formed in the workpiece holder 32. The supporting plate 52 also has formed thereon a corresponding recess so that the supporting plate is moved together with the workpiece holder 32. The supporting plate 52 is provided with a guiding canal 56 having a rectangular hollow profile and a slot 58 at the side turned to the needle bar 15. As the double seam 59 (which also formed the thread chain 41 in a preceding operation) fixes a hem 60 through a plurality of material layers, the hem 60 may be guided in the guiding canal 56. The workpiece 3 is led throughout the slot 58, so that the individual workpieces 3 are positioned transversally with respect to the guiding canal 56 and are well-positioned with respect to the needle 57. In order to facilitate the feeding of the individual workpieces 3 into the guiding canal 56, there is provided a feed hopper 61 opened at the side turned to the reel 39. For the detection of the leading edge 95 of the workpiece 3 the sewing head 4 is provided with a stationary sensor 53 in the area of the needle 57.

To the workpiece holder 32 there is attached a sensor 62, i.e. a reflecting light barrier sensing the arrival of the trailing edge 79 of the workpiece 3. This sensor 62 defines the correct position of each workpiece 3 to be sewn in the main feed direction from the reel 39 to the reel 43 relatively to the workpiece holder 32, while the guiding canal 56 defines the position in cross direction relatively to the reel 39, 43 and the exact angle position.

Above the plate 5 a bracket 63 for carrying a feeding device 65 is swingably or pivotably supported at one end of the axis 31 by means of bearings 64. The feeding device 65 substantially consists of a conveyor belt 56 guided via a driven roller 67 and an idling roller 68. The driven roller 67 is driven by a motor 67'.

Figure 4:
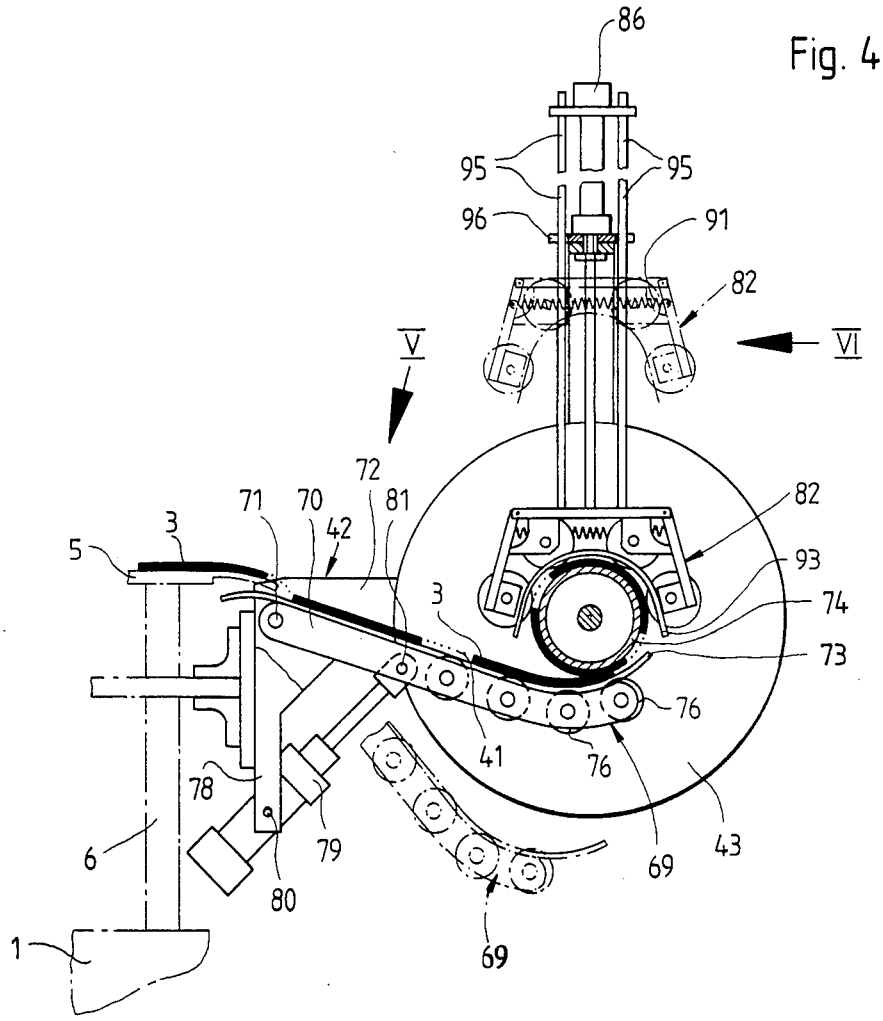
FIG. 4 is a side view of a reel, on an enlarged scale.
Figure 3:
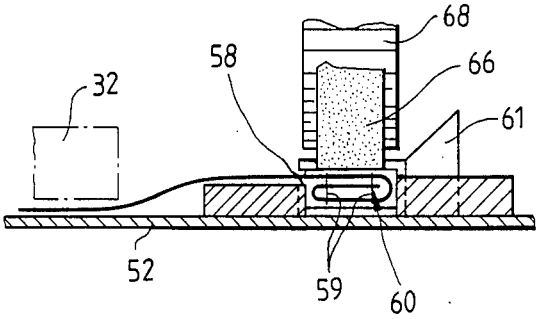
FIG. 3 is a partial section taken along line III—III in FIG. 2.

To the bearing block 42 there is swingably supported a lower winder support 69 consisting of two levers 70, which extend parallelly to each other and are swingable about a common axis 71. The axis 71 in turn is swingably supported in two arms 72 extending parallelly to each other and substantially forming the bearing block 42. To the levers 70 there is mounted a guiding plate 73 projecting nearly below the plate 5 at the side of the stand 1. At the side of the reel 43, the guiding plate 73 is bent upwardly into the direction of the core 74 of the reel 43 as illustrated in FIG. 4.

Between the levers 70 there are supported shafts 75 extending parallelly to each other and provided with rollers 76 having equal diameters. Neighbouring shafts 75 are each connected by timing belt drives 77. If one shaft 75 is driven, all rollers 76 are driven in the same direction of rotation. The rollers 76 have the same peripheral speed as the RPM-rate is 1:1 and as the diameters of all rollers are equal. The rollers 76 slightly project through the guiding plate 73 as to directly get into contact with the workpieces 3 sliding thereover.

A pneumatic piston-cylinder-drive 79 is swingably or pivotably supported about an axis 80 at the downwardly extending arms 78 of the bearing block 42. The other end of the piston-cylinder-drive 79 is swingably or pivotably supported to the levers 70 about an axis 81. The distance between the axis 81 and the axis 71 is large enough, so that the winder support 69 may be moved by means of the drive 79 from a lower position to an upper working position as indicated by a dot-dash-line in FIG. 4. In this position, the free end of the guiding plate 73 is located closely to the core 74 of the reel 43, and the two outer rollers 76 rest against the core 74. Thus, all rollers 76 are driven as described into the opposite direction of rotation with respect to the core 74 resp. the reel 43. The outer surface of the cylindrical core 74 is coated with rubber or another soft material having a suitable coefficient of friction.

Above the reel 43 there is provided an upper winder support 82, which is mounted to a supporting frame 83 arranged at the bearing block 42. To the upper cross head 84 of the supporting frame 83 there is secured a cylinder 85 of a pneumatic piston-cylinder-drive 86 to the piston rod 87 of which is secured the actual winder support 82. The upper winder support 82 is provided with two pairs of rollers 88, which are arranged symmetrically with respect to the piston rod 87. Also symmetrically arranged with respect to the piston rod 87 there are pivoted pairs of rollers 90 to tilt levers 89. The tilt levers 89 are connected to force-storing-means formed as a tension spring 91, so that they are always drawn into an inner position. This inner position and thus the travel of the tilt levers 89 is limited by stops 92, so that all rollers 88, 90 are positioned with their inner circumference on a cylinder section corresponding to the core 74 of the reel 43. In the area of the fastening of the rollers 90 to the tilt levers 89 there is mounted a resilient guiding plate 93, through which slightly project the rollers 89, 90. When the correspondingly actuated upper winder support 82 is moved towards the core 74, this guiding plate 93 encases with little distance the upper half of the core 74 of the reel 43 in such a manner that the rollers 88, 90 rest against the core 74.

At the upper carrier 94 of the upper winder support 82, to which are connected the tilt levers 89 and the piston rod 87, there are provided two upwardly projecting guide bars 95, which are longitudinally guided in at least one guide plate 96. This guide plate 96 is not rotatable with respect to the supporting fram 83, so that the upper winder support 82 itself is secured against torsion by this guidance.

Operation is described as follows:

After inserting a full reel 39 into the bearing block 30, the first workpiece 3 - in this case a pre-sewn pocket cut - is manually inserted into the feed hopper 61 and brought into engagement with the conveyor belt 66. When the leading edge 98 seen in the main feed direction 97 has reached a stationary sensor 53, which usually is formed by a reflecting light barrier, the sewing head 4 will be started in order to produce the mentioned seam 54 in the workpiece 3. Beginning of sewing causes pressurizing of the piston-cylinder-drive 79, so that the lower winder support 69 is moved from its dot-dashed position in FIG. 4 into its upwardly tilted position. In this position the guiding plate 73 is positioned closely to the core 74, and the pair of rollers 76 associated to the core 74 rests against the latter. Simultaneously the motor 45 is switched on and thus the reel 43 is driven at a low RPM-rate. The rollers will rotate in the same manner as already described. The already sewn workpieces 3 running off the plate 5 onto the guiding plate 73 of the winder support 69, are fed by the rollers 76 into the direction towards the reel 43. At this, a spring loaded tilt lever 102 pivotably arranged at the bearing block 42 serves for laterally guiding the workpieces 3. The first workpiece 3 reaching the reel 43 is positioned towards the core 74 of the reel 43 at the point of contact between the lower winder support 69 and the core 74 as obvious from FIG. 4. At this instant the upper winder support 82 is moved downwardly by the correspondingly pressurized piston-cylinder drive 86, so that the rollers 88, 90 engage the core 74 and the guide plate 93 encases the upper area of the core 74. Pressurizing of the drive 86 is released by an electrical control 99 provided with a present switch 100, which is set to a predetermined number of workpieces to be sewn prior to the triggering of the drive 86. This number of workpieces 3 corresponds to the distance from the sensor 53 to the approaching area between the lower winder support 69 and the core 74, at which, of course, the distance of the individual workpieces 3 to each other has to be considered. By pressurizing the drive 86, the upper winder support 82 is moved from the dot-dashed upper position into the lower position as shown in full lines in FIG. 4.

After sewing a further number of workpieces 3, which may be present by a further present switch 101 located at the electrical control 99, the piston-cylinder-drive 86 is pressurized in reverse order, so that the upper winder support 82 returns into its dot-dash-lined inoperative position. This second number of workpieces 3 at least corresponds to the circumference of the core 74. If one layer of workpieces 3 is wound onto the core 74, it clamps automatically thereon by itself, so that the function of the upper winder support 82 is no longer required.

The automatic sewing machine continues to work fully automatically, i.e. the workpieces 3 will be wound continuously onto the reel 43. The lower winder support 69 engages with a slight pressure the workpieces 3 wound onto the core 74 of the reel 43. As the lower winder support 69 is pressed up with slight force only, it may yield downwardly according to the increasing diameter of the wound workpieces 3. Due to the spring loaded suspension of the tilt levers 89 a yielding of the rollers 90 is obtained, as the diameter of wound on workpieces 3 increases. The motor 45 steadily effects a slight tension on the workpieces 3 to be wound.

Operation of the automatic sewing machine is described in detail in U.S. patent application Ser. No. 06/672,278, now U.S. Pat. No. 4,580,509, to which is herewith referred to.

What we claim is:

1. In an automatic sewing machine for successively sewing workpieces flexibly connected to one another by at least one thread chain, said sewing machine having:

a sewing head;

a reel receiving individual workpieces positioned behind said sewing head, said reel having a core, having a substantially cylindrical curvature;

said reel comprising a lower winder support arranged in front of said reel for feeding and guiding said workpieces connected one to another onto said core of said reel;

an upper winder support which is engageable with said core and which at least partially encases said core at the side opposite to the lower winder support;

said upper winder support being provided with a plurality of rollers, which rollers partially encase said core, and being freely driven by said core;

at least two rollers provided adjacent to one another and not being displaceable to one another;

at least two rollers being supported to two tilt levers, respectively;

the tilt levers being arranged on opposite sides of the at least two rollers not being displaceable to one another;

and the tilt levers being loaded by force storing means in a direction towards said core.

2. In an automatic sewing machine according to claim 1, wherein said lower winder support for feeding said workpiece is provided with rollers drivable in the same circumferential direction and at the same circumferential speed at the core.

3. In an automatic sewing machine according to claim 2, wherein said rollers are arranged on shafts parallel one to each other and are totatingly drivably coupled to one another by means of timing belt drives.

4. In an automatic sewing machine according to claim 3, wherein at least one roller is engageable with said core.

5. In an automatic sewing machine according to claim 4, wherein said lower winder support is provided with a guiding plate, said rollers projecting through said guiding plate and the end of said guiding plate located adjacent to said core being adapted to the curvature of said core.

6. In an automatic sewing machine according to claim 5, wherein said lower winder support is yieldingly pressable against said reel by means of a pneumatic piston-cylinder-drive.

7. In an automatic sewing machine according to claim 6, wherein stops for limiting the travel of said tilt levers to said core are provided.

8. In an automatic sewing machine according to claim 7, wherein said upper winder support is provided with a guiding plate partially encasing said core.

9. In an automatic sewing machine according to claim 8, wherein stops for limiting the travel of said tilt levers to said core are provided, wherein said upper winder support is provided with a guiding plate partially encasing said core and wherein said guiding plate is connected to said tilt levers.

10. In an automatic sewing machine according to claim 8, wherein said guide plate of said upper winder support is elastic.

* * * * *